United States Patent [19]

Anayama

[11] Patent Number: 4,908,288

[45] Date of Patent: Mar. 13, 1990

[54] ELECTROPHOTOGRAPHIC PHOTOSENSITIVE MEMBER

[75] Inventor: Hideki Anayama, Yokohama, Japan

[73] Assignee: Canon Kabushiki Kaisha, Tokyo, Japan

[21] Appl. No.: 236,220

[22] Filed: Aug. 25, 1988

[30] Foreign Application Priority Data

Aug. 27, 1987 [JP] Japan ..... 62-211339

[51] Int. Cl.[4] ..... G03G 15/02

[52] U.S. Cl. ..... 430/58; 430/96

[58] Field of Search ..... 430/58, 59, 96

[56] References Cited

U.S. PATENT DOCUMENTS 4,485,159 11/1984 Watanabe et al. ..... 430/96

4,637,971 1/1987 Takei et al. ..... 430/96

4,803,140 2/1989 Hira ..... 430/58

*Primary Examiner*—John L. Goodrow

*Attorney, Agent, or Firm*—Fitzpatrick, Cella, Harper & Scinto

[57] ABSTRACT

An electrophotographic photosensitive member has a charge generation layer and a charge transport layer on a conductive substrate, wherein the monomer unit constituting a polymer binder contained in said charge generation layer is the same as that constituting a polymer binder contained in said charge transport layer, and the weight-averaged molecular weight of the polymer binder contained in said charge generation layer is in a range from two to six times of that of the polymer binder contained in said charge transport layer.

7 Claims, 1 Drawing Sheet

ELECTROPHOTOGRAPHIC PHOTOSENSITIVE MEMBER

BACKGROUND OF THE INVENTION

1. Field of the Invention

The present invention relates to an electrophotographic photosensitive member, and more particularly to an electrophotographic photosensitive member containing macromolecular binders of particular molecular weights respectively in the charge generation layer and in the charge transport layer.

2. Related Background Art

There are recently proposed electrophotographic photosensitive members of a laminate structure in which the photosensitive layer is functionally divided into a charge generation layer and a charge transport layer. These photosensitive members have been improved in the sensitivity to visible light, charge retentive force, surface strength etc. as disclosed in the U.S. Pat. Nos. 3,837,851 and 3,871,882.

Such photosensitive member of separated functions is composed at least of a charge generation layer and a charge transport layer. In such photosensitive member, the charge carriers generated by light absorption in the charge generation layer are injected into the charge transport layer and migrate to the surface thereof, thus dissipating the surface charge of the photosensitive member and creating an electrostatic contrast.

For said process of electrostatic image formation, it is required that the charge generation layer is capable of uniformly generating abundant charge carriers and efficiently injecting thus generated charge carriers into the charge transport layer, and that the charge transport layer can cause efficient migration of the charge carriers, injected from the charge generation layer. As the charge generation layer is basically a mixture of an organic pigment serving as a charge generating material and a binder while the charge transport layer is basically a mixture of an organic dye serving as a charge transporting material and a binder, the electrophotographic characteristics of the photosensitive member, such as sensitivity, potential characteristics and durability are significantly influenced by the basic structure, functional groups, molecular weight, purity etc. of the polymer compound employed as the binder.

However, though research has been made on the structure of the binder of the charge transport layer principally for improving the durability, research has scarcely been made on the binder for the charge generation layer except for the dispersibility and the adhesion property. Also there has scarcely been investigated the influence of the binder on the interaction between the charge generation layer and the charge transport layer. Consequently the conventional electrophotographic photosensitive member of separated function type have not been satisfactory in potential characteristics such as retentitive potential and photomemory performance.

In recent years, there have been increasingly proposed technologies utilizing polycarbonate resins as the binder for the charge generation layer and the charge transport layer as disclosed in the Japanese Laid-open Patent Nos. 59-227597 and 61-137157, and these technologies have resulted in a certain improvement in the retentive potential and photomemory performance of the photosensitive member.

However, if such polycarbonate resins are used as binders for both the charge generation layer and the charge transport layer, a part of the charge generation layer is dissolved into the coating solution for the charge transport layer when it is coated on the charge generation layer already coated, and a loss in sensitivity results from such dissolving of the charge generation layer into the charge transport layer. Also, in the mass production of the electrophotograhic photosensitive members, it is difficult to mass produce the photosensitive members in uniform quality, since the materials of the charge generation layer are gradually accumulated in the coating solution for the charge transport layer.

For avoiding such dissolution, there is considered a method of immersing a substrate after the coating of the charge generation layer momentarily in the coating solution for the charge transport layer and pulling up said substrate before the dissolution of the charge generation layer starts, or a spray coating method, or a coating method by pushing up a cylindrical substrate. Though these methods are suitable for production of a small quantity, they are not suitable for mass production, for example, because they require a number of equipment several times larger than that of the equipment for ordinary dip coating.

SUMMARY OF THE INVENTION

The present inventors have reached the present invention through investigations made for resolving the above-explained drawbacks of the conventional electrophotographic photosensitive members.

An object of the present invention is to provide an electrophotographic photosensitive member excellent in electrophotographic characteristics such as sensitivity and photomemory performance.

Another object of the present invention is to provide an electrophotographic photosensitive member capable of maintaining uniform quality even in mass production.

The foregoing objects can be achieved, according to the present invention, by an electrophotographic photosensitive member having a charge generation layer and a charge transport layer on a conductive substrate, wherein the monomer unit constituting the polymer binder contained in said charge generation layer is same as the monomer unit constituting the polymer binder contained in said charge transport layer, and the weight-averaged molecular weight of the polymer binder contained in said charge generation layer is two to six times of that of the polymer binder contained in said charge transport layer.

DETAILED DESCRIPTION OF THE PREFERRED EMBODIMENTS

Figure 1:
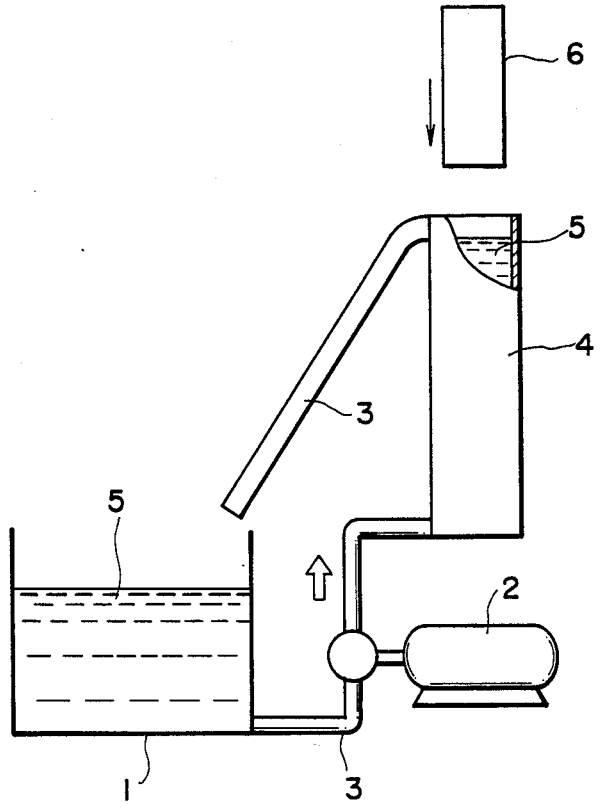
FIG. 1 is a schematic view of a dipping apparatus to be employed in examples 5 and 6 of the present invention.

The mechanism of improvement of the electrophotographic characteristics of the photosensitive member such as sensitivity and photomemory performance in the present invention has not been thoroughly clear, but the use of a same monomer unit for constituting the polymer binder to be contained in the charge generation layer and the polymer binder to be contained in the charge transport layer, and the use of a weight-averaged molecular weight for the polymer binder in the charge generation layer which is two to six times of the weight-averaged molecular weight of the polymer binder in the charge transport layer are considered to create suitable mutual solubility between the charge generation layer and the charge transport layer at the preparation of the photosensitive member, thereby increasing the efficiency of charge carrier injection at the interface and thus improving the sensitivity and the photomemory performance. If the weight-averaged molecular weight of the polymer binder in the charge generation layer is less than twice of that of the polymer binder in the charge transport layer, there will presumably result excessive dissolution, thus leading to local peeling of the charge generation layer which is considerably thinner than the charge transport layer, thereby reducing the efficiency of carrier generation and deteriorating the sensitivity. On the other hand, if the former is more than six times of the latter, there will result excessively little mutual dissolution, thus reducing the efficiency of carrier injection at the interface and deteriorating the sensitivity. In this state the efficiency of carrier generation is not lowered, whereby there will result an increase in the amount of free charge carriers, giving rise to deterioration of the memory characteristics such as photomemory performance.

The weight-averaged molecular weight of the polymer binder (hereinafter simply called binder) in the charge generation layer is not particularly limited, but is preferably in a range from 12,000 to 2,000,000, particularly from 40,000 to 600,000 if the coating solution for forming the charge generation layer is prepared by an ordinary dispersing method such as with sand mill or ball mill.

Also the weight-averaged molecular weight of the binder in the charge transport layer is not particularly limited, but is preferably in a range from 6,000 to 1,000,000, particularly from 10,000 to 300,000.

The binder to be incorporated in the charge generation layer or in the charge transport layer is not particularly limited, but is preferably composed of a polymer compound with a dielectric constant not exceeding 3.5. Examples of such polymer compounds with a dielectric constant not exceeding 3.5 include polycarbonate resins, polymethyl methacrylate, polystyrene resins, polyacrylate resins, and styrene-methyl methacrylate copolymers.

The weight mixing ratio of the charge generating material to the binder is variable according to the kind of charge generating material, but is generally in a range of 5 to 0.1 parts of the binder with respect to 1 part of the charge generating material, preferably from 1 to 0.2 parts of the binder.

The weight mixing ratio of the charge transport material to the binder is variable according to the kind of the charge transporting material, but is generally in a range from 3 to 0.1 parts, preferably 2 to 0.5 parts, of the binder with respect to 1 part of the charge transporting material.

The charge generation layer or the charge transport layer may contain, in addition to the binder of the present invention, other polymer compounds or polymer compounds of different weight-averaged molecular weight as a lubricant, a viscosity regulating agent etc., if the content thereof does not exceed 10 wt.% of that of the binder of the present invention.

The charge generation layer to be employed in the present invention can be obtained by dispersing, in said binder, an organic pigment selected from charge generating materials including pyrilium dyes, thiopyrilium dyes, azulenium dyes, phthalocyanine pigments, antanthrone pigments, dipenztyrenequinone pigments, pyranthrone pigments trisazo pigments, disazo pigments, azo pigments, indigo pigments, quinachrydone pigments, asymmetric quinocyanine dyes and quinocyanine dyes.

In the preparation of coating solution for the charge generation layer by dispersing said charge generating material in the binder of the present invention, there may be employed an organic solvent of which examples include ketones such as acetone, methylethylketone or cyclohexanone; amides such as N,N-dimethylformamide or N,N-dimethylacetamide; sulfoxides such as dimethylsulfoxide; ethers such as tetrahydrofurane, dioxane or ethyleneglycol monomethylether; esters such as methyl acetate or ethyl acetate; aliphatic halogenated hydrocarbons such as chloroform, methylene chloride, dichloroethylene, carbon tetrachloride or trichloroethylene; and aromatic hydrocarbons such as benzene, toluene, xylene, ligroin, monochlorobenzene or dichlorobenzene.

Dispersion can be achieved to a desired particle size by placing said solvent, charge generating material and binder in a sand mill, a ball mill, a roll mill or an attriter. The particle size and the amount of binder should be carefully considered as they have significant influence on the stability of dispersion and the characteristics of the photosensitive member.

Coating can be made for example by a dip coating, spray coating, spinner coating, bead coating, Mayer bar coating, blade coating, roller coating or curtain coating.

The coated film is preferably dried at room temperature to a touch dry state, followed by drying under heating. The heat drying is preferably conducted for 5 minutes to 2 hours at a temperature of 30° to 200° C.

In order to obtain a sufficiently high absorbance, the charge generation layer should preferably contain as much charge generating material as possible, and, in order to reduce the stroke of the generated charge carriers, it is preferably made thin, for example with a thickness not exceeding 5 μm, preferably in a range of 0.01 to 1 μm. This is due to requirements that a major portion of the incident light is absorbed in the charge generation layer for generating a large amount of charge carriers, and that the charge carriers have to be injected into the charge transport layer without deactivation by recombination or trapping.

The charge transport layer is electrically connected to the charge generation layer explained above, and has a function of receiving the charge carriers injected from the charge generation layer under the presence of an electric field, and transporting said carriers to the surface. The charge transport layer is preferably laminated on the charge generation layer.

The charge transporting material to be incorporated in the charge transport layer is preferably an organic charge transporting material, of which examples include fluorenones such as 2,4,7-trinitro-9-fluorenone or 2,4,5,7-tetranitrofluorenone; carbazoles such as N-isopropylcarbazole or N-methyl-N-phenylhydrazino-3-methylidene-9-ethylcarbazole; hydrazones such as p-diethylaminobenzaldehyde-N,N-diphenylhydrazone, p-diethylaminobenzaldehyde-N-αnaphthyl-N-phenylhydrazone or p-pyrrolidinobenzaldehyde-N,N-diphenylhydrazone; pyrazolines such as 1-[quinolyl(2)]-3-(p-diethylaminostyryl)-5-(p-diethylaminophenyl)pyrazoline or 1-[pyridyl(2)]-3-(p-diethylaminostyryl)-5-(p-diethylaminophenyl)pyrazoline; styryl compounds such as 9-p-dibenzylaminobenzylidene-9H-fluorenone or 5-p-ditolylaminobenzylidene-5H-diazo[α, d]cycloheptane;

oxazoles such as 2-(p-diethylaminostyryl)-6-diethylaminobenzoxazole or 2-(p-diethylaminophenyl)-4-(p-dimethylaminophenyl)-5-(2-chlorophenyl)oxazole; thiazoles such as 2-(p-diethylaminostyryl)-6-diethylaminobenzothiazole; triarylmethanes such as bis(4-diethylamino-2-methylphenyl)phenylmethane; and polyarylalkanes such as 1,1-bis(4-N,N-diethylamino-2-methylphenyl)heptane or 1,1,2,2-tetraquis(4-N,N-dimethylamino-2-methylphenyl)ethane.

These charge transporting materials can be employed singly or as a mixture of two or more kinds.

The charge transport layer cannot be made excessively thick, since the transportation of the charge carriers has a certain limit. In general the thickness is in a range of 5 to 30 μm, preferably 8 to 20 μm.

The photosensitive layer of a laminate structure consisting of such charge generation layer and charge transport layer is provided on a conductive substrate. Said substrate can be composed of a material which is conductive by itself, such as aluminum, aluminum alloys, copper, zinc or stainless steel; a plastic material having thereon a vacuum evaporated film of aluminum, an aluminum alloy, indium oxide, tin oxide or an indium oxide-tin oxide alloy; a substrate composed of a plastic material or an above-mentioned substrate coated with conductive particles such as carbon black or powdered silver together with a suitable binder; a plastic or paper material impregnated with conductive particles; or a plastic material containing conductive polymer. A subbing layer with a barrier function and an adhering function may be provided between said conductive substrate and the photosensitive layer. Said subbing layer may be composed of casein, polyvinyl alcohol, nitrocellulose, ethylene-acrylic acid copolymer, polyamide such as nylon-6, nylon-66, nylon-610, copolymerized nylon or alkoxymethylated nylon; polyurethanes; gelatine or aluminum oxide.

The thickness of the subbing layer is generally in a range of 0.1 to 5 μm, preferably 0.5 to 3 μm.

EXAMPLES

Now the present invention will be further clarified by examples thereof.

Example 1

(i) A bisphenol compound of the following structure:

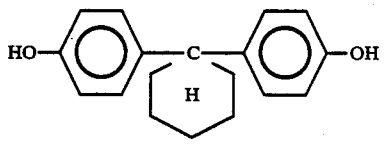

was dissolved in a mixture of aqueous solution of alkali and methylene chloride under normal pressure and normal temperature, and fosgen gas was reacted by blowing into thus obtained solution. Polycarbonate resins of eight weight-averaged molecular weights (Mw) shown in Tab. 1 were prepared by varying the reaction time and the amount of phosgene:

TABLE 1

| No. | Mw |
|---|---|
| 1 | 6,200 |
| 2 | 8,900 |
| 3 | 13,200 |
| 4 | 18,300 |
| 5 | 22,000 |
| 6 | 40,000 |
| 7 | 83,000 |
| 8 | 88,000 |

(ii) 11.2% solution of casein in ammonia (1 g of ammonia water in 222 ml of water) was coated on an aluminum substrate sheet with a Meyer bar to a thickness of 0.5 μm after drying.

Then an azo pigment of the following structure:

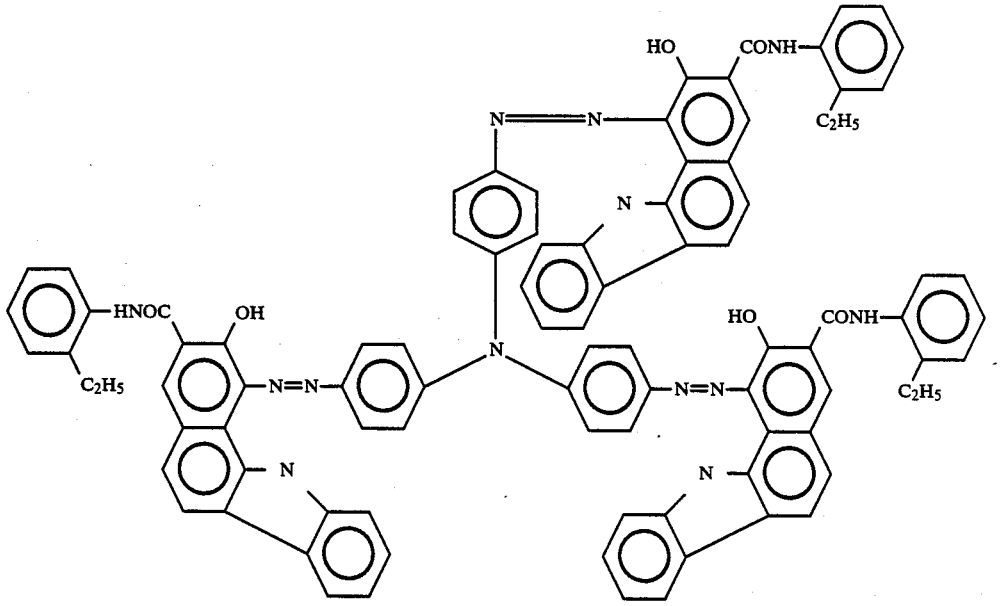

in an amount of 1 gr. was added to solution of 0.5 gr. of one of the binders of Nos. 1–8 dissolved in 25 gr. of cyclohexanone, and the mixture was subjected to dispersion, with 30 ml of glass beads, for 10 hours in a paint shaker. The obtained dispersion was coated with a Meyer bar and dried so as to obtain a thickness of 0.5 μm after drying, thereby forming a charge generation layer.

(iii) A hydrazone compound of the following structure:

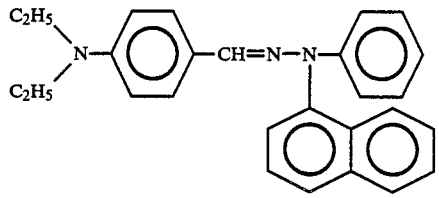

in an amount of 400 gr. and a polycarbonate resin of No. 4 (Mw=18,300) in amount of 400 gr. were dissolved in 2.4 kg of chlorobenzene. The obtained solution was placed in a 5-l beaker. The aluminum sheet, bearing the coated charge generating layer thereon, was immersed in said solution over a period of 10 seconds, then let to stand in the solution for 5 seconds, and pulled out therefrom over a period of 15 seconds. The coating was then dried to obtain a charge generating layer of a thickness of 18 μm.

(Measurement of sensitivity)

The electrophotographic photosensitive member prepared in this manner was subjected to the measurement of charging characteristics by static corona charging at −5 kV with a test equipment for electrostatic copying paper (Model SP-428 manufactured by Kawaguchi Denki Co.), followed by holding for 1 second in the dark and an exposure to light with a luminocity of 2 lux. The charging characteristics were evaluated by the measurement of the surface potential ($V_0$) before exposure, and the amount of exposure ($E_{\frac{1}{2}}$) required for attenuating the surface potential after a dark delay for 1 second, to a half, and the results are shown in Tab. 2.

(Measurement of photomemory performance)

The photosensitive member was irradiated for 5 minutes with light of 500 lux from a lamp, (for photography) as a light source, then left to stand for 5 minutes in a dark place and was charged with the same conditions as in the measurement of sensitivity explained before. Then the surface potential was measured, and the photomemory performance was defined by the difference from the surface potential $V_0$ before exposure. The obtained results are shown in Tab. 2.

TABLE 2

| Mw of binder in charge generation layer | $E_{\frac{1}{2}}$ (lux · sec) | $V_0$ (V) | Photomemory performance (V) |
|---|---|---|---|
| 6200 | 3.2 | −830 | −30 |
| 8900 | 3.0 | −810 | −30 |
| 13200 | 2.2 | −730 | −25 |
| 18300 | 2.10 | −740 | −25 |
| 22000 | 2.00 | −730 | −25 |
| 40000 | 1.85 | −710 | −15 |
| 83000 | 1.83 | −720 | −20 |
| 88000 | 1.87 | −710 | −15 |

Results in Tab. 2 indicate that a photosensitive member, in which Mw of the polycarbonate resin in the charge generation layer is equal to or more than twice of Mw of the polycarbonate resin in the charge transport layer has a sensitivity higher than that of a photosensitive member in which Mw of the polycarbonate resin in the charge generation layer is less than twice of Mw of the polycarbonate resin in the charge transport layer.

Examples 2, 3

The experiment of the example 1 was reproduced except that the binder of the charge transport layer was replaced by the sample No. 2 (Mw=8900) (example 2) or No. 6 (Mw=40000) (example 3), and the obtained results are respectively shown in Tabs. 3 and 4.

TABLE 3

| Mw of binder in charge generation layer | $E_{\frac{1}{2}}$ (lux · sec) | $V_0$ (V) | Photomemory performance (V) |
|---|---|---|---|
| 6200 | 2.95 | −810 | −15 |
| 8900 | 2.55 | −780 | −20 |
| 13200 | 2.20 | −740 | −25 |
| 18300 | 1.86 | −710 | −20 |
| 22000 | 1.81 | −700 | −15 |
| 40000 | 1.85 | −705 | −15 |
| 83000 | 1.97 | −710 | −20 |
| 88000 | 2.10 | −715 | −30 |

TABLE 4

| Mw of binder in charge generation layer | $E_{\frac{1}{2}}$ (lux · sec) | $V_0$ (V) | Photomemory performance (V) |
|---|---|---|---|
| 6200 | 2.80 | −800 | −35 |
| 8900 | 2.60 | −780 | −30 |
| 13200 | 2.70 | −780 | −30 |
| 18300 | 2.75 | −750 | −30 |
| 22000 | 2.60 | −780 | −35 |
| 40000 | 2.50 | −780 | −20 |
| 83000 | 1.80 | −710 | −20 |
| 88000 | 1.80 | −715 | −15 |

Results of example 2 (Tab. 3) and example 3 (Tab 4) indicate that satisfactory sensitivity and photomemory performance can be obtained when a same monomer unit is employed for constituting binders for the charge generation layer and the charge transport layer and Mw of the binder of the charge generation layer is equal to or larger than that of the binder of the charge transport layer. Also the results in Tab. 3 indicate that the sensitivity and photomemory performance are deteriorated if Mw of the binder of the charge generation layer exceeds 6 times of that of the charge transport layer.

Comparative Example 1

Photosensitive member were prepared by the method of example 1, except that polyvinyl butyral was employed as the binder for the charge generation layer. The molecular weight of polyvinyl butyral and degree of butyralation are shown in Tab. 5.

TABLE 5

| Sample No. | Mw | Degree of butyralation (mol %) |
|---|---|---|
| 9 | 15700 | 67.0 |
| 10 | 23000 | 65.0 |
| 11 | 42000 | 66.5 |
| 12 | 83000 | 66.8 |
| 13 | 92000 | 65.2 |
| 14 | 110000 | 65.0 |

Measurements were conducted as in example 1, and the obtained results are shown in Tab. 6.

TABLE 6

| Mw of binder of charge generation layer | $E_{\frac{1}{2}}$ (lux· sec) | $V_0$ (V) | Photomemory performance (V) |
|---|---|---|---|
| 15700 | 2.7 | −750 | −100 |
| 23000 | 2.65 | −740 | −110 |
| 42000 | 2.70 | −745 | −120 |
| 83000 | 2.66 | −745 | −115 |
| 92000 | 2.72 | −730 | −110 |
| 110000 | 2.75 | −740 | −120 |

Comparative Example 2

Photosensitive member were prepared in the same manner as the example 1, except that polymethyl methacrylate was employed as the binder of the charge generation layer. The molecular weight of polymethyl methacrylate (PMMA) is shown in Tab. 7.

TABLE 7

| Sample No. | Mw |
|---|---|
| 15 | 22000 |
| 16 | 27000 |
| 17 | 43000 |
| 18 | 58000 |
| 19 | 112000 |
| 20 | 170000 |
| 21 | 580000 |

Measurements were conducted as in the example 1, and the obtained results are shown in Tab. 8.

TABLE 8

| Mw of binder of charge generation layer | $E_{\frac{1}{2}}$ (lux · sec) | $V_0$ (V) | Photomemory performance (V) |
|---|---|---|---|
| 22000 | 2.60 | −750 | −70 |
| 27000 | 2.65 | −750 | −80 |
| 43000 | 2.35 | −720 | −90 |
| 58000 | 2.0 | −730 | −95 |
| 112000 | 2.10 | −700 | −110 |
| 170000 | 2.15 | −720 | −85 |
| 580000 | 2.5 | −750 | −40 |

Comparative Example 1 (Tab. 6) and Comparative Example 2 (Tab. 8) indicate that the use of polyvinyl butyral resin which is not mutually soluble with the binder of the charge generation layer results in deterioration of the sensitivity and photomemory performance, and that the use of a binder of a different structure which has a certain mutual solubility improves the sensitivity to a level close to that in the example 1 but cannot improve the photomemory performance.

Example 3

Photosensitive member were prepared in the same manner as in the example except that PMMA was employed as the binder of the charge generation layer and the charge transport layer. In addition to the foregoing samples Nos. 15–21, there was added another sample No. 22 with Mw=12000. (The reaction conditions of the samples Nos. 15–22 are different since PMMA of suitable molecular weight was selected from various reaction products obtained by solution or bulk polymerization.)

Photosensitive members were prepared by employing the samples Nos. 15 and 18 as the binder of the charge transport layer, and were subjected to measurements as in the example 1. The obtained results are shown in Tabs. 9 and 10.

TABLE 9

(Sample No. 15 (Mw = 22000) used in the charge transport layer)

| Mw of binder of charge generation layer | $E_{\frac{1}{2}}$ (lux · sec) | $V_0$ (V) | Photomemory performance (V) |
|---|---|---|---|
| 12000 | 3.56 | −850 | −45 |
| 22000 | 2.80 | −780 | −35 |
| 27000 | 2.55 | −740 | −40 |
| 43000 | 2.11 | −710 | −40 |
| 58000 | 2.05 | −715 | −25 |
| 112000 | 2.00 | −700 | −30 |
| 170000 | 2.15 | −710 | −40 |
| 580000 | 2.50 | −720 | −45 |

TABLE 10

(Sample No. 18 (Mw = 58000) used in the charge transport layer)

| Mw of binder of charge generation layer | $E_{\frac{1}{2}}$ (lux · sec) | $V_0$ (V) | Photomemory performance (V) |
|---|---|---|---|
| 12000 | 3.60 | −845 | −30 |
| 22000 | 3.00 | −790 | −25 |
| 27000 | 2.95 | −785 | −30 |
| 43000 | 2.81 | −780 | −30 |
| 58000 | 2.31 | −740 | −35 |
| 112000 | 2.05 | −700 | −25 |
| 170000 | 2.00 | −710 | −20 |
| 580000 | 2.15 | −715 | −45 |

EXAMPLE 4

Photosensitive members were prepared as in the example 1, except that polystyrene was employed as the binder for the charge generation layer and the charge transport layer.

Mw of synthesized polystyrene are shown in Tab. 11

TABLE 11

| Sample No. | Mw |
|---|---|
| 23 | 11000 |
| 24 | 20000 |
| 25 | 53000 |
| 26 | 88000 |
| 27 | 112000 |
| 28 | 156000 |

Polystyrene was principally synthesized with bulk polymerization at different temperature and with variable amount of initiator (azobisisobutyronitrile), and suitable Ms values were selected from various reaction products.

Photosensitive members were prepared employing the sample No. 24 as the binder for the charge transport layer, and were subjected to measurements as in the example 1. The obtained results are shown in Tab. 12.

TABLE 12

(Sample No. 24 (Mw = 20000) used in the charge transport layer)

| Mw of binder of charge generation layer | $E_{\frac{1}{2}}$ (lux · sec) | $V_0$ (V) | Photomemory performance (V) |
|---|---|---|---|
| 11000 | 2.75 | −770 | −10 |
| 20000 | 2.45 | −720 | −15 |
| 53000 | 1.87 | −700 | −10 |
| 88000 | 1.88 | −695 | −10 |
| 112000 | 1.85 | −705 | −15 |

TABLE 12-continued

| (Sample No. 24 (Mw = 20000) used in the charge transport layer) | | | |
|---|---|---|---|
| Mw of binder of charge generation layer | $E_{\frac{1}{2}}$ (lux · sec) | $V_0$ (V) | Photomemory performance (V) |
| 156000 | 2.02 | −700 | −20 |

Example 3 (Tabs. 9 and 10) and example 4 (Tab. 12) indicate that the effect is not dependent on the kind of binder.

As shown by the examples 1 to 4, the sensitivity and photomemory performance can be improved by the use of a binder, in the charge generation layer, consisting of a monomer unit same as that constituting the binder of the charge transport layer and having Mw of two to six times of that of the latter binder.

Example 5

Coating solutions for forming the charge transport layer (CT solutions) were prepared as in the example 1, employing the samples Nos. 2, 3, 4 and 5 as the binder.

Also coating solutions for forming the charge generation layer (CG solutions) were prepared as in the example 1, employing the samples Nos. 1–8 as the binder.

These CG and CT solutions were used for coating in the coating equipment shown in FIG. 1. In said equipment, coating solution 5 contained in a tank 1 is supplied, by a circulating pump 2, through a pipe 3 to a coating pot 4, and is coated on the external surface of an article 6 immersed in said coating pot 4. The coating solution overflowing at the dipping returns to the tank 1 through a pipe 3. In the present example, the Mw of the binder of the CG solution is selected in excess of but closest to twice of the Mw of the binder used in the CT solution.

At first CG solution was coated and dried for 5 minutes at 50° C. After standing for 30 seconds, CT solution was immediately coated and dried for 30 minutes at 100° C.

500 photosensitive members were continuously prepared with such coating equipment, and evaluation as in the example 1 was conducted on the 1st and 500th photosensitive members. The obtained results are shown in Tab. 13.

TABLE 13

| | | 1st photosensitive member | | | 500th photosensitive member | | |
|---|---|---|---|---|---|---|---|
| Mw of binder in CT solution | Mw of binder in CG solution | $E_{\frac{1}{2}}$ (lux · sec) | $V_0$ (V) | Photomemory performance (V) | $E_{\frac{1}{2}}$ (lux · sec) | $V_0$ (V) | Photomemory performance (V) |
| 8900 | 18300 | 1.86 | −700 | −25 | 2.11 | −730 | −55 |
| 13200 | 40000 | 1.85 | −720 | −25 | 2.05 | −735 | −40 |
| 18300 | 40000 | 1.80 | −710 | −25 | 1.85 | −715 | −20 |
| 22000 | 83000 | 1.90 | −720 | −20 | 1.90 | −735 | −20 |

Example 6

The process of the example 5 was reproduced except that PMMA of samples Nos. 22, 15 and 17 were employed as the binder of the charge transport layer and the samples Nos. 16, 18 and 19 were employed as the binder of the charge generation layer. The obtained results are shown in Tab. 14.

TABLE 14

| | | 1st photosensitive member | | | 500th photosensitive member | | |
|---|---|---|---|---|---|---|---|
| Mw of binder in CT solution | Mw of binder in CG solution | $E_{\frac{1}{2}}$ (lux · sec) | $V_0$ (V) | Photomemory performance (V) | $E_{\frac{1}{2}}$ (lux · sec) | $V_0$ (V) | Photomemory performance (V) |
| 12000 | 27000 | 2.03 | −700 | −30 | 2.22 | −735 | −50 |
| 22000 | 58000 | 2.00 | −720 | −25 | 2.05 | −730 | −30 |
| 43000 | 112000 | 2.05 | −710 | −35 | 2.08 | −715 | −35 |

Example 5 (Tab. 13) and example 6 (Tab. 14) indicate that even mass-produced photosensitive members show little change and deterioration in the sensitivity and photomemory performance. Particularly stable results in the sensitivity and photomemory performance can be obtained by the use of a binder with Mw equal to or larger than 40000 in the CG solution.

What is claimed is:

1. An electrophotographic photosensitive member having a charge generation layer and a charge transport layer on a conductive substrate, wherein the monomer unit constituting a polymer binder contained in said charge generation layer is the same as that constituting a polymer binder contained in said charge transport layer, and the weight-averaged molecular weight of the polymer binder contained in said charge generation layer is in a range from two to six times of that of the polymer binder contained in said charge transport layer.

2. An electrophotographic photosensitive member according to claim 1, wherein said polymer binder is selected from a group consisting of polycarbonates resins, polymethyl methacrylate resins, polystyrene resins, polyacrylate resins, and styrene methyl methacrylate copolymers.

3. An electrophotographic photosensitive member according to claim 1, wherein the weight-averaged molecular weight of the polymer binder contained in the charge generation layer is in a range from 40,000 to 600,000.

4. An electrophotographic photosensitive member according to claim 1, wherein the weight-averaged molecular weight of the polymer binder contained in the charge transport layer is within a range from 10,000 to 300,000.

5. An electrophotographic photosensitive member according to claim 3, wherein the weight-averaged molecular weight of the polymer binder contained in the charge transport layer is within a range from 10,000 to 300,000.

6. An electrophotographic photosensitive member according to claim 1, wherein the weight mixing ratio of the polymer binder and a charge generating material in the charge generation layer is within a range of 5 to 0.1 parts of the polymer binder with respect to 1 part of the charge generating material.

7. An electrophotographic photosensitive member according to claim 1, wherein the weight mixing ratio of the polymer binder and a charge transporting material in the charge transport layer is within a range of 3 to 0.1 parts of the polymer binder with respect to 1 part of the charge transporting material.

* * * * *

UNITED STATES PATENT AND TRADEMARK OFFICE

CERTIFICATE OF CORRECTION

PATENT NO. : 4,908,288

DATED : March 13, 1990

INVENTOR(S) : HIDEKI ANAYAMA

It is certified that error appears in the above-identified patent and that said Letters Patent is hereby corrected as shown below:

Title page:

IN [56] REFERENCES CITED

U.S. PATENT DOCUMENTS, "Hira" should read --Hiro--.

COLUMN 2

Line 7, "electrophotograhic" should read --electrophotographic--.
Line 26, "inventors have" should read --inventor has--.
Line 42, "same" should read --the same--.

COLUMN 4

Line 2, "pigments" should read --pigments,--.
Line 22, "attriter." should read --attritor.--.
Line 28, "Mayer" should read --Meyer--.
Line 61, "N-αnaphthyl" should read --N-α-naphthyl--.

COLUMN 6

Line 19, "fosgen gas" should read --phosgene gas--.

COLUMN 7

Line 34, "luminocity" should read --luminosity--.

COLUMN 8

Line 51, "member" should read --members--.

UNITED STATES PATENT AND TRADEMARK OFFICE

CERTIFICATE OF CORRECTION

PATENT NO. : 4,908,288

DATED : March 13, 1990

INVENTOR(S) : HIDEKI ANAYAMA

It is certified that error appears in the above-identified patent and that said Letters Patent is hereby corrected as shown below:

COLUMN 9

Line 14, "member" should read --members--.
Line 54, "member" should read --members--.
Line 55, "the example" should read --Example 1--.

COLUMN 10

Line 31, "EXAMPLE 4" should read --Example 4--.
Line 51, "Ms values" should read --Mw values--.

COLUMN 12

Line 39, "polycarbonates" should read --polycarbonate--.

Signed and Sealed this

Fifteenth Day of October, 1991

*Attest:*

*Attesting Officer*

HARRY F. MANBECK, JR.

*Commissioner of Patents and Trademarks*